US006904634B2

(12) United States Patent
Smith

(10) Patent No.: US 6,904,634 B2
(45) Date of Patent: Jun. 14, 2005

(54) MULTIPURPOSE 1911 PISTOL SERVICING TOOL

(76) Inventor: Gary H. Smith, 4825 Vermont Rte. 14, Hardwick, VT (US) 05843

( * ) Notice: Subject to any disclaimer, the term of this patent is extended or adjusted under 35 U.S.C. 154(b) by 1 day.

(21) Appl. No.: 10/679,211

(22) Filed: Oct. 6, 2003

(65) Prior Publication Data

US 2005/0071925 A1 Apr. 7, 2005

(51) Int. Cl.[7] ..... B25B 7/22
(52) U.S. Cl. ..... 7/128; 81/426; 81/426.5
(58) Field of Search ..... 7/128, 127, 151, 7/170; 81/418, 424.5, 426, 426.5

(56) References Cited

U.S. PATENT DOCUMENTS 6,282,997 B1 * 9/2001 Frazer ..... 81/427.5
6,389,625 B1 * 5/2002 Rivera ..... 7/128
6,578,221 B2 * 6/2003 Ping ..... 7/128

* cited by examiner

*Primary Examiner*—Jacob K. Ackun, Jr.
(74) *Attorney, Agent, or Firm*—John J. Welch, Jr., Esq.

(57) ABSTRACT

A multipurpose 1911 pistol servicing tool consisting of two pliers heads pivotably assembled together with each pliers head having pivotably affixed to it a three-sided handle and with one handle having pivotably affixed to it and within it a series of screwdriver blade components and a file component and with the other handle having pivotably affixed to it and within it, a pair of accessory punch components, a hexagonal driver component and a round file component.

1 Claim, 6 Drawing Sheets

MULTIPURPOSE 1911 PISTOL SERVICING TOOL

CROSS REFERENCES TO PRIOR OR PARENT APPLICATIONS

There are no prior or parent applications in respect of the instant invention.

FEDERALLY SPONSORED RESEARCH AND DEVELOPMENT

There are no federally sponsored research and development undertakings in respect of the instant invention.

BACKGROUND OF THE INVENTION

1. Field of the Invention

The instant invention relates to that grouping of devices serving the function of maintaining and repairing firearms.

2. Related Art

Your inventor is aware of no art that anticipates the instant invention.

SUMMARY OF THE INVENTION

1. A Brief Description of the Invention

The invention is a multipurpose tool for purposes of assembly or disassembly of 1911 style pistols. It consists of two pliers heads serving to form upon closure of one against the other a bushing wrench and pliers. The pliers can serve to grasp and hold a barrel bushing component of such a pistol, and can also function as a wire or spring cutter. Each pliers head is pivotably affixed to a three-sided handle. Each handle services to control a pliers head. Each pliers head is held to the other by way of a rivet. One handle moreover has pivotably assembled to it and within it a series of accessory screwdriver blade components and a file component. The other handle has pivotably assembled to it and within it a pair of accessory punch components, a hexagonal driver component and a round file component.

2. An Object of the Invention

The instant invention uniquely provides for a bushing wrench serving to aid in the removal and installation of a 1911 pistol barrel bushing component while likewise providing for pliers heads that can perform the clamping tasks of ordinary pliers or serve to cut springs as well as forming the equivalent of a webhole that allows the barrel portion of such a pistol to pass through it and a bottomside round hole before the topside webhole actually tightly engages the bushing component. This feature of the invention allows for a very secure purchase of the bushing much moreso than as with resort to use of other wrenches currently available for grasping the bushing. Such is the case, since, there is automatic alignment of the webhole aspect of the invention with the pistol. The very great advantage to such automatic and eminently more secure purchase of the bushing is the virtually complete obviation of slippage such as, for example, often mars the finish of the pistol. Finally, the invention is readily foldable into a 1911 magazine pouch or into one's pocket while likewise featuring a number of attached accessory components for purposes of facilitating servicing of such a style pistol with maximal convenience and efficiency.

A DESCRIPTION OF THE DRAWINGS

A DESCRIPTION OF THE PREFERRED EMBODIMENT

Figures 1, 2:
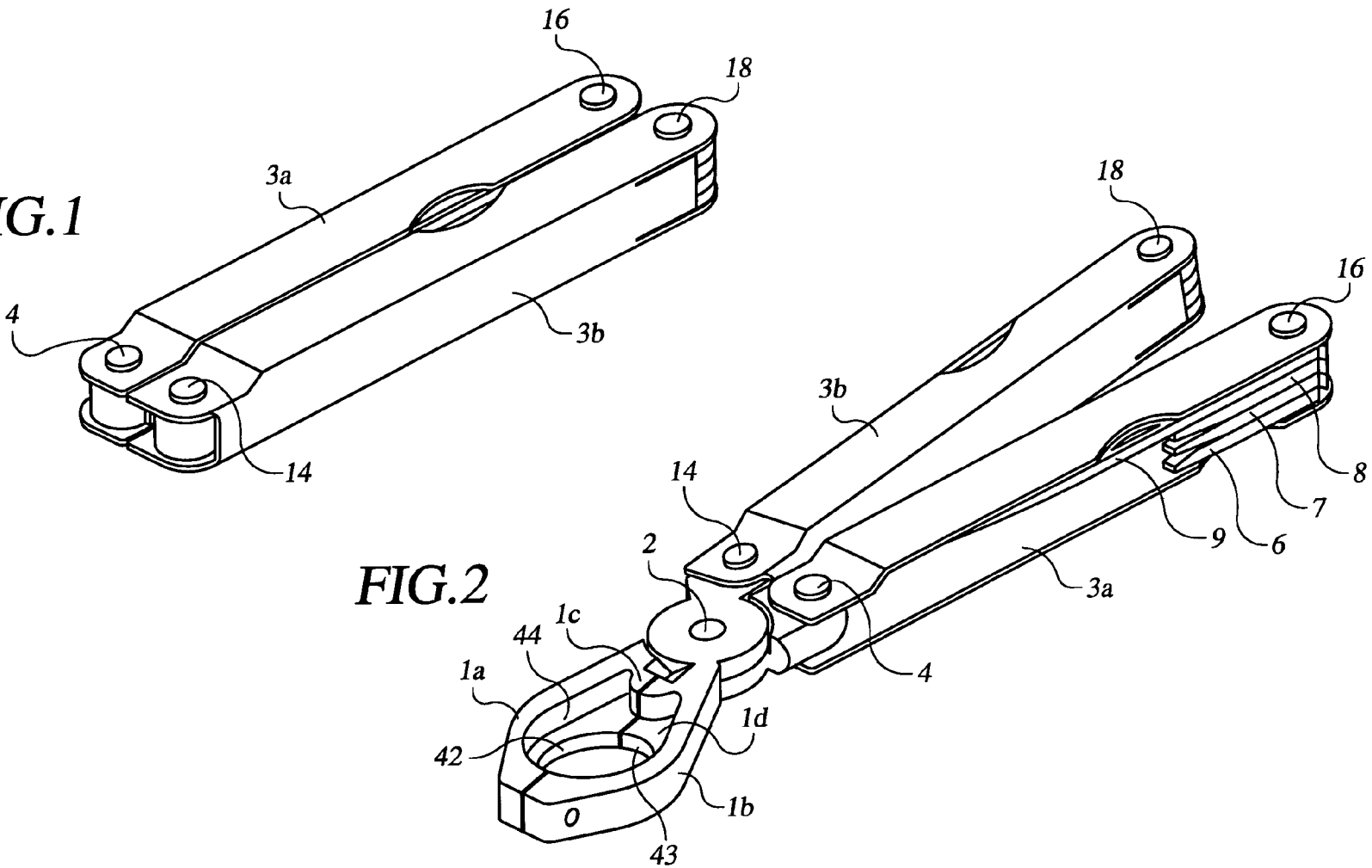
FIG. 1 is a perspective view of the invention in a folded state.
FIG. 2 is a perspective view of the invention in an unfolded state.
Figure 4:
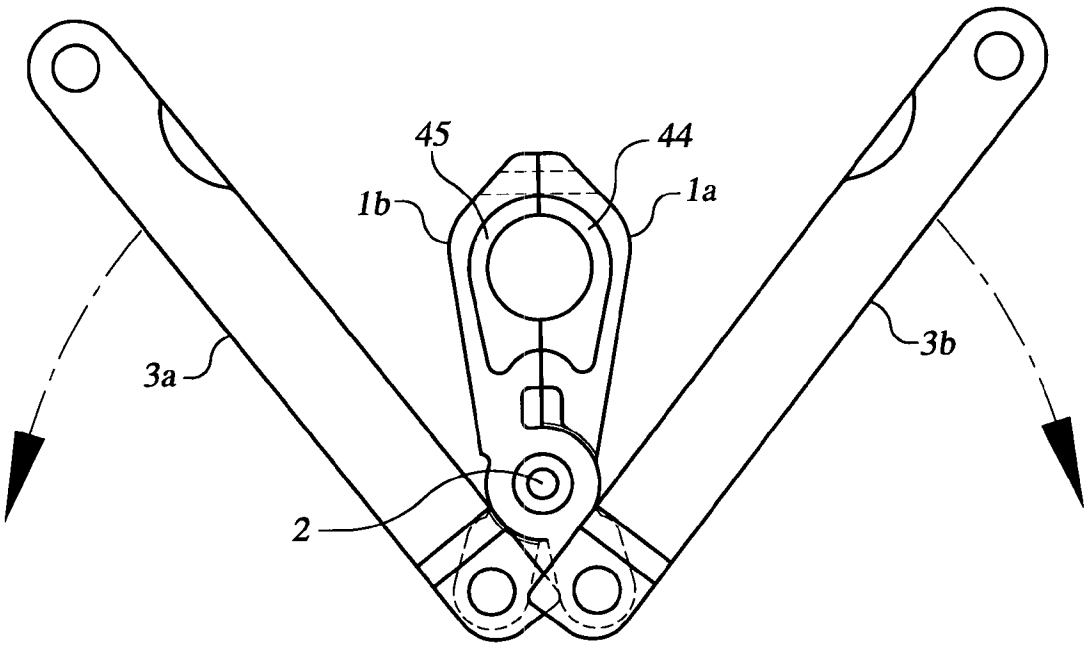
FIG. 4 is a top plan view of the invention shown being unfolded.
Figure 3:
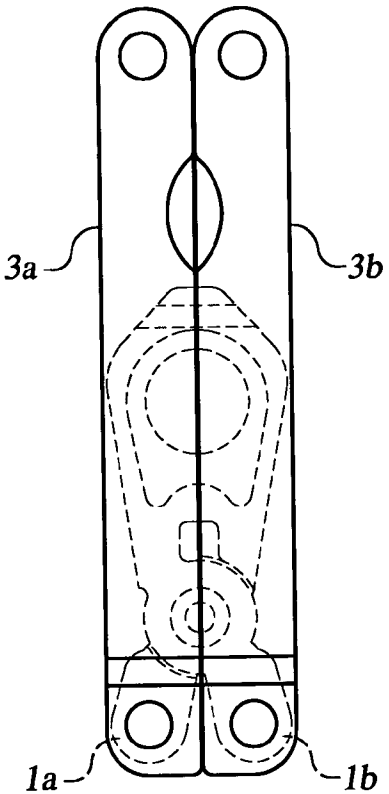
FIG. 3 is a top plan view of the invention in a folded state.
Figure 6:
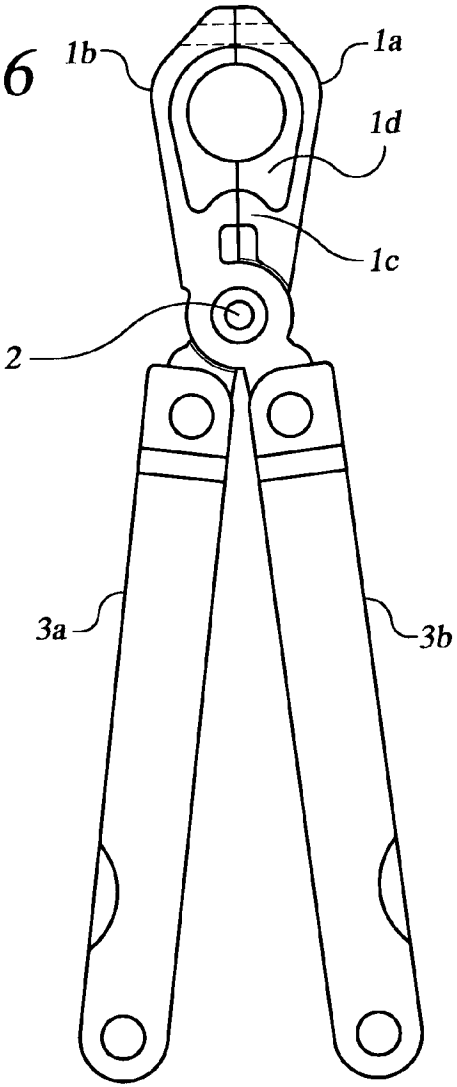
FIG. 6 is a top plan view of the invention in an unfolded state.
Figure 5:
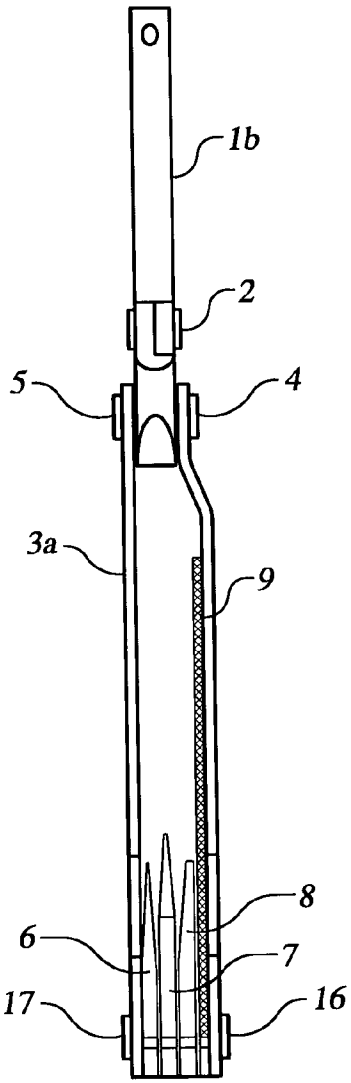
FIG. 5 is a right lateral plan view of the invention in an unfolded state.
Figure 8:
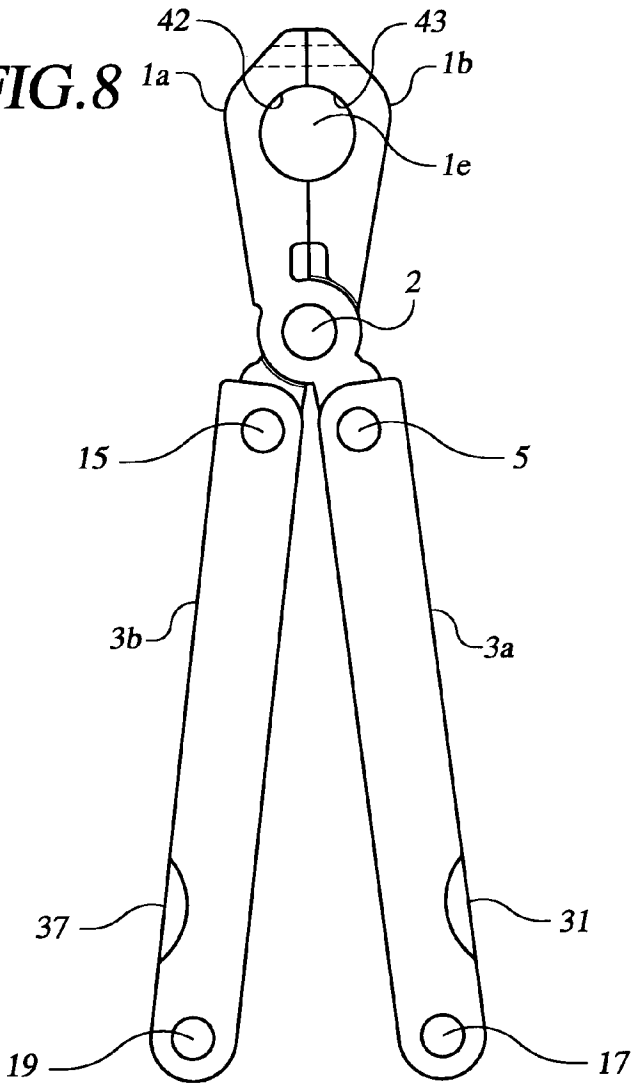
FIG. 8 is a bottom plan view of the invention in an unfolded state.
Figure 7:
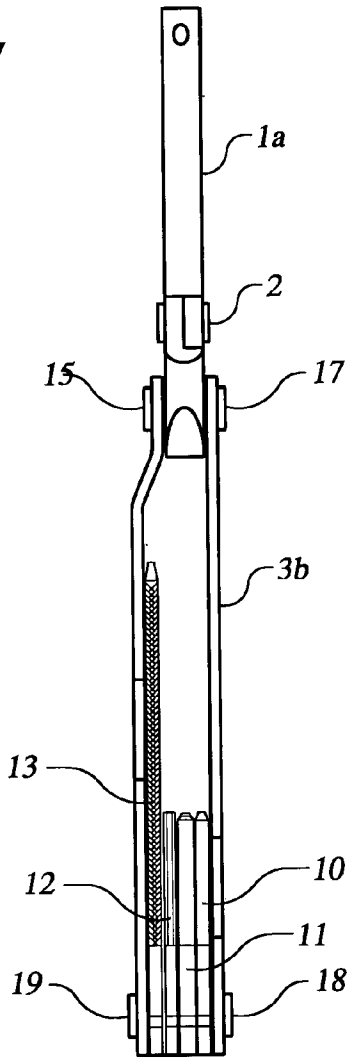
FIG. 7 is a left lateral plan view of the invention in an unfolded state.
Figure 9:
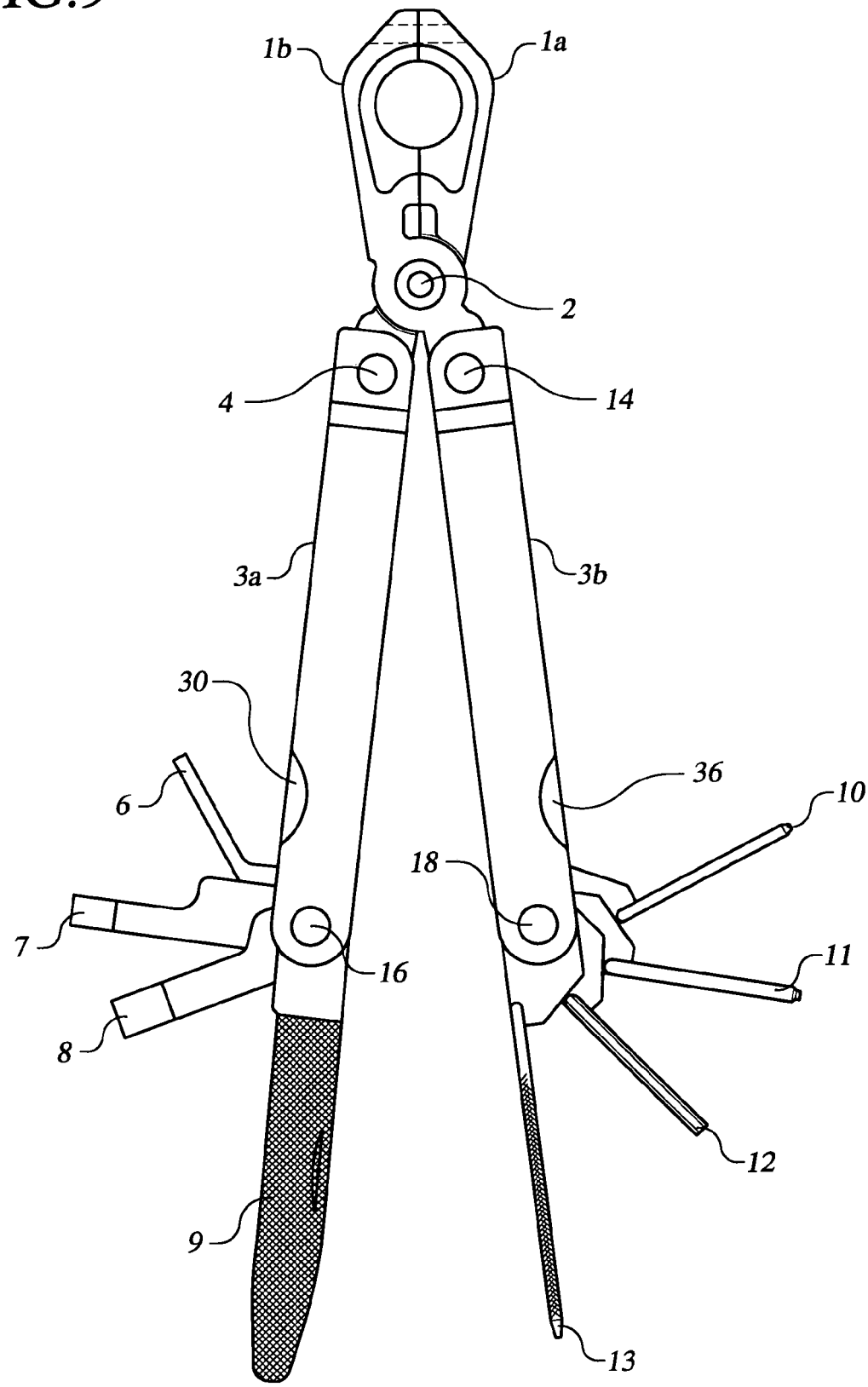
FIG. 9 is a top plan view of the unfolded invention illustrating the various accessory components thereof in an unfolded state.
Figure 10:
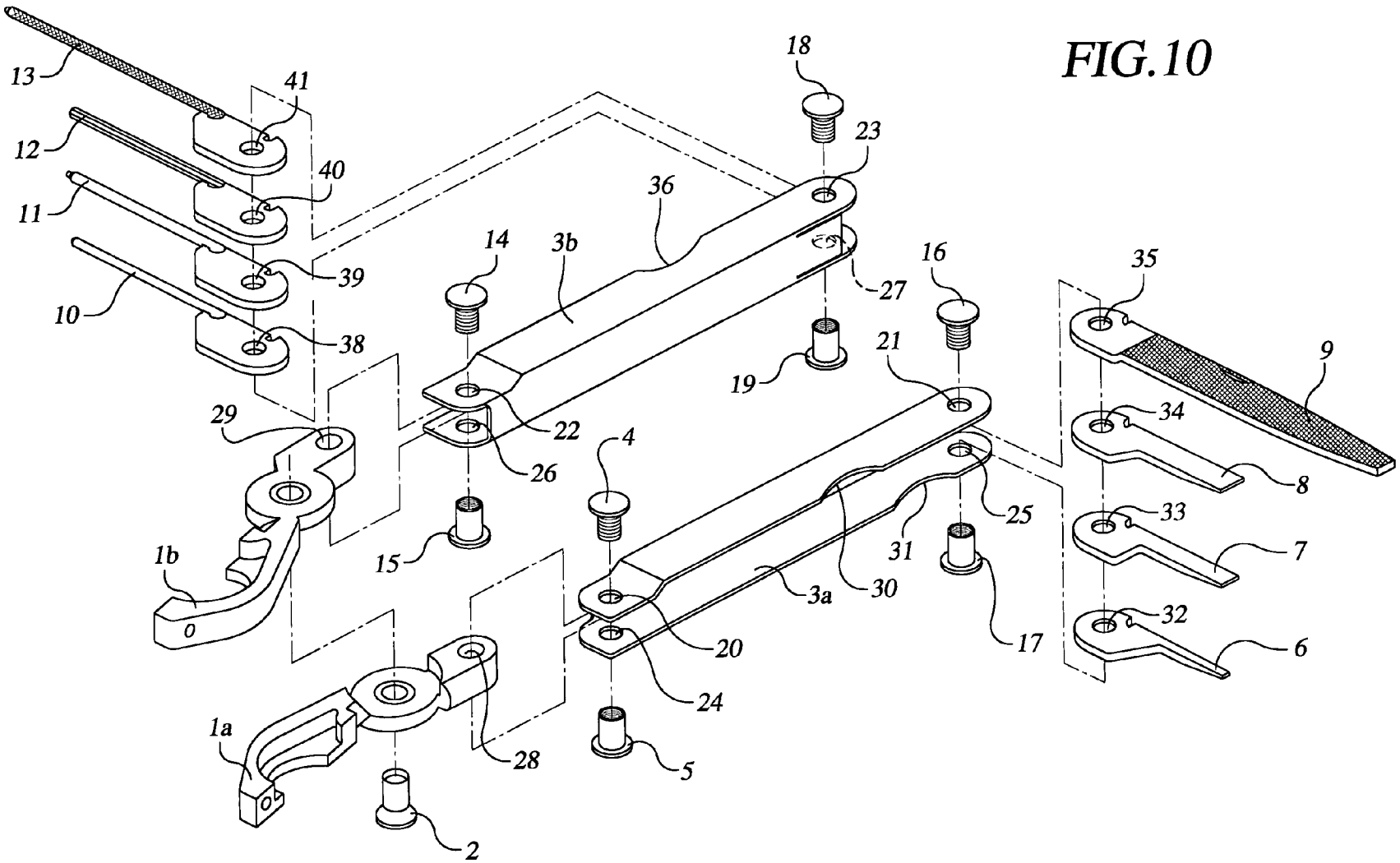
FIG. 10 is an exploded view of the various components of the invention in close apposition to one another.

FIGS. 1 and 2 are perspective views of the instant invention in the folded and unfolded states respectively. FIGS. 3 and 4 are top plan views of the instant invention shown as folded and then being unfolded respectively. FIG. 6 shows the instant invention in top plan view in an unfolded state. FIG. 8 is a bottom plan view of the instant invention in an unfolded invention. FIGS. 5 and 7 are lateral plan view of the instant invention. FIG. 9 is a top plan view of the instant invention serving to illustrate the various accessory components of the instant invention in an unfolded state as to each respectively. FIG. 10, an exploded view of the various components of the invention shown in close apposition to one another enables one to appreciate the intricacies of the invention in a manner consistent with the overall functionality and versatility of the invention. With resort to FIG. 10 first pliers head 1*a* is pivotably conjoined with second pliers head 1*b* via first rivet 2 insertable through concentrically aligned first pliers head through hole 42 and second pliers head through hole 43 respectively. A first three-sided handle 3*a* is pivotably conjoined near a first end thereof with pliers head 1*a* via first pivot screw 4 threadably inserted through first topside first handle hole 20 and first pliers head open hole 28, then first bottomside first handle hole 24, with, all of the same being secured via a threading of screw 4 into first pivot screw threaded bushing unit 5. A second three-sided handle 3*b* is pivotably conjoined near a first end thereof with pliers head 1*b* via second pivot screw 14 threadably inserted through first topside second handle hole 22, second pliers head open hole 29 and then first bottomside second handle hole 26 with all of the same being secured via a threading of screw 14 into second pivot screw threaded bushing unit 15. First screwdriver blade component 6, second screwdriver blade component 7, third screwdriver blade component 8 and first file component 9 with reference again to FIG. 10 are all pivotably conjoined near a second end of handle 3*a* via first screwdriver headhole 32, second screwdriver head hole 33, third screwdriver headhole 34 and first file headhole 35 respectively into all of which there is threadably inserted third pivot screw 16 through second topside first handle hole 21 and second bottomside first handle hole 25 with the whole of all of the same being secured by way of threadable insertion of screw 16 into third pivot screw threaded bushing unit 17, all of which can be seen likewise with reference to FIG. 10. First punch component 10, second punch component 11, hexagonal driver component 12 and second file component 13 with reference again to FIG. 10 are all pivotably conjoined near a second end of handle 3*b* via first punch headhole 38, second punch headhole 39, hexagonal driver headhole 40, and second file headhole 41 respectively into all of which there is threadably inserted fourth pivot screw 18 through second topside second handle hole 23 and second bottomside second handle hole 27 with the whole of all of the same being secured by way of threadable insertion of screw 18 into fourth pivot screw threaded bushing unit 19, all of which can be seen likewise with reference to FIG. 10. First handle topside concavity 30 and first handle bottomside concavity 31 are shown in FIG. 10 cut into the topside and the bottomside of handle 3*a* respectively. Second handle topside concavity 36 is shown in FIG. 10 as being cut into the topside of handle 3*b*. Second handle bottomside concavity 37 as shown in FIG. 8 as being cut into the bottomside of handle 3*b*. Concavities 30, 31, 36 and 37 serve to facilitate ready access to components 6, 7, 8, 9 and 10, 11, 12 and 13 respectively by way of simply grasping them individually in-situ as shown in FIGS. 2, 5, and 7 with a thumb and index finger to thereby open them out for utilization as shown in FIG. 9. The intact invention can be readily and conveniently carried about in the folded state as shown in FIG. 1. FIG. 3 illustrates how hollowed out handles 3*a* and 3*b* serve to cradle pliers heads 1*a* and 1*b* when the invention is in a folded state. Grasping handles 3*a* and 3*b* together and pulling each outwardly as shown in FIG. 4 enables the invention to be readily unfolded for use in terms of assembling and disassembling 1911 style pistols. When the invention is unfolded as shown in FIG. 2 or FIG. 6, the pliers heads 1*a* and 1*b* in apposition to one another in what would then be a closed pliers complex is slid over the barrel of the pistol so as to be positioned to depress the recoil plug of the pistol via the convex shaped pliers base 1*c* of the complex which base 1*c* is located at the bottom of the webhole 1*d* formed by the closure together of heads 1*a* and 1*b* as the complex firmly engages the bushing of the pistol within webhole 1*d*. Base 1*c* and webhole 1*d* are shown in numbered form in FIGS. 2 and 6. Webhole 1*d* with a perimeter slightly in excess of that of the barrel bushing unit of a 1911 style pistol is found when a first topside cut 44 in the topside of pliers head 1*a* with depth and contour equal to the contour of one-half of a barrel bushing unit of a 1911 style pistol comes into apposition with a second topside cut 45 in the topside of pliers head 1*b* with depth and contour equal to the contour of the second half of the barrel bushing unit described above as when first pliers head 1*a* is closed as against second pliers head 1*b* when the invention is in a wholly unfolded state. In such a state, the lowermost portion of cut 44 and the lowermost portion of cut 45 form base 1*c* all of which can be seen with resort to FIGS. 2, 4 and 6. The complex so formed by the pliers heads in apposition to one another serves as a wrench device that can readily be utilized to rotate the barrel bushing component of such a pistol a quarter of a turn clockwise to free the recoil plug and recoil spring assembly of the pistol so as to facilitate disassembly of the pistol or alternatively to thereafter rotate the bushing a quarter of a turn counterclockwise to restabilize in place the recoil plug and recoil spring assembly of the pistol so as to facilitate assembly of the pistol. When hole 1*d* circumscribes the bushing of the pistol as base 1*c* depresses the recoil plug of the pistol located thereon just below the bushing component thereof, round bottomhole 1*e* of the complex shown in FIG. 8 circumscribes the barrel component of the pistol. Roundhole 1*e* with a diameter slightly in excess of the diameter of the barrel of a 1911 style pistol is formed by way of the coming together in apposition to one another of first semicircular cut 42 in the bottom side of pliers head 1*a* which bottomside is, in turn, in apposition with the topside thereof and second semicircular cut 43 in the bottom side of pliers head 1*b* which bottom side thereof is, in turn, also in apposition with the topside of pliers head 1*b*.

Screwdriver blade components 6, 7 and 8 are of various sizes to facilitate removal or installation of pistol grip screws, grip bushings, magazine catch components or the adjustment of sight components on the pistol. Punch components 10 and 11 of differing sizes are utilized to remove or insert the pistol's hammer pin, mainspring housing retainer pin, facilitate disassembly or assembly of the pistol's mainspring housing or align sear and disconnector during disassembly or assembly of the pistol. Hexagonally shaped driver component 12 also serves to facilitate removal or installation of screws, magazine catches and two piece guide rods in respect of disassembly or assembly of a 1911 pistol. It also functions to facilitate adjustment of trigger over-travel. File components 9 and 13 of differing sizes enable one to file down variously sized pistol components as needed. The instant invention is an intact unit consisting of virtually all of the tool pieces needed for ready disassembly or reassembly of 1911 style pistols. All of the accessory tool pieces thereof namely accessory components 6, 7, 8, 9 and then 10, 11, 12 and 13 as are neatly and uniquely pivotably affixed to handles 3*a* and 3*b* respectively as shown as noted above in FIGS. 2, 5 and 7 thereby serve to ultimately provide an extremely useful device for purposes of assembly and disassembly of such pistols that is not only very conveniently all-purpose but likewise eminently portable as well. All of these tools are always to be found together thereby obviating a need to be required to retrieve and replace each of them from and into different places in one's shop as is presently the case when one would seek to service such a pistol. Likewise the pliers heads clamped in apposition to one another can, in addition to serving as a bushing wrench via webhole 1*d* can also serve as a form of wire cutter device for cutting pistol spring components. Finally, the feature of the invention whereby round bottom hole 1*e* engages the barrel of a 1911 pistol as webhole 1*d* engages the bushing thereof while pliers base 1*c* compresses the recoil plug thereof makes for very secure purchase of the bushing while concomitantly greatly easing the process of pistol disassembly or reassembly. Such secure purchasing of the pistol's bushing serves to greatly minimize and indeed virtually obviate slippage during the performance of such operations thereby avoiding any marring of the finish of the pistol.

In conclusion, for the reasons cited above, the instant invention is respectfully submitted, indeed a device that is truly new, useful and unique.

What is claimed is:

1. A multipurpose 1911 pistol servicing tool, comprising:

a. a first pliers head;

b. a second pliers head;

c. a first rivet;

d. said first pliers head having a bottom side with depth within the whole of which there is a first semicircular cut;

e. said second pliers head having a bottom side with depth within the whole of which there is a second semicircular cut;

f. said first semicircular cut forming together with said second semicircular cut a circular hole with a diameter slightly in excess of the diameter of a barrel of a 1911 style pistol when said first pliers head is closed as against said second pliers head as when the invention is in a wholly unfolded state;

g. said first pliers head having a top side with depth and in apposition to said bottom side thereof within the whole of which said topside there is a first topside cut contoured equivalently to the outer contour of one-half of a barrel bushing component of a 1911 style pistol;

h. said second pliers head having a top side with depth and in apposition to said bottom side thereof within the whole of which said topside there is a second topside cut contoured equivalently to the outer contour of a second half of said barrel bushing component of said 1911 style pistol;

i. said first topside cut forming together with said second topside cut a webshaped hole with a perimeter slightly in excess of the perimeter of said barrel bushing component when said first pliers head is closed as against said second pliers head as when the said invention is in a wholly unfolded state;

j. a lowermost portion of said first topside cut together with a lowermost portion of said second topside cut forming a convex shaped base portion of a complex formed when said first pliers head is closed as against said second pliers head as when the said invention is in a wholly unfolded state;

k. said first pliers head being pivotably assembled by way of said first rivet inserted via a first pliers head through hole in said first pliers head to said second pliers head via such insertion of said first rivet into a second pliers head through hole in said second pliers head;

l. a first three sided handle;

m. a second three sided handle;

n. a first topside first handle hole located in a topside of said first handle;

o. a first bottomside first handle hole located in a bottom side of said first handle;

p. said first topside first handle hole being concentrically aligned with said first bottomside first handle hole;

q. a first pliers head open hole located in said first pliers head;

r. a first pivot screw;

s. a first pivot screw threaded bushing unit;

t. said first three sided handle being pivotably assembled to said first pliers head via said first pivot screw being inserted into said first pivot screw threaded bushing unit via said first topside first handle hole, said first pliers head open hole and said first bottomside first handle hole;

u. a first topside second handle hole located in a topside of said second handle;

v. a first bottomside second handle hole located in a bottom side of said second handle;

w. said first topside second handle hole being concentrically aligned with said first bottomside second handle hole;

x. a second pliers head open hole located in said second pliers head;

y. a second pivot screw;

z. a second pivot screw threaded bushing unit;

aa. said second three-sided handle being pivotably assembled to said second pliers head via said second pivot screw being inserted into said second pivot screw threaded bushing unit via said first topside second handle hole, said second pliers head open hole and said first bottomside second handle hole;

bb. a second topside first handle hole located in said topside of said first handle;

cc. a second bottom side first handle hole located in said bottom side of said first handle concentrically aligned with said second topside first handle hole;

dd. a laterally located concavity in said topside of said first handle;

ee. a laterally located concavity in said bottom side of said first handle;

ff. a third pivot screw;

gg. a third pivot screw bushing unit;

hh. a first screwdriver blade component;

ii. a first screwdriver blade component headhole;

jj. a second screwdriver blade component;

kk. a second screwdriver blade component headhole;

ll. a third screwdriver blade component;

mm. a third screwdriver blade component headhole;

nn. a first file component;

oo. a first file component headhole;

pp. said first screwdriver blade component, said second screwdriver blade component, said third screwdriver blade component and said first file component being pivotably assembled to and within said first handle by way of a threading of said third pivot screw through said second topside first handle hole, said first screwdriver blade component headhole, said second screwdriver blade component headhole, said third screwdriver blade component headhole, said first file component headhole, then said second bottomside first handle hole into said third pivot screw bushing unit;

qq. a second topside second handle hole located in said topside of said second handle;

rr. a second bottom side second handle hole located in said bottom side of said second handle and concentrically aligned with said second topside second handle hole;

ss. a laterally located concavity in said topside of said second handle;

tt. a laterally located concavity in said bottom side of said handle;

uu. a fourth pivot screw;

vv. a fourth pivot screw bushing unit;

ww. a first punch component;

xx. a first punch component headhole;

yy. a second punch component;

zz. a second punch component headhole;

aaa. a hexagonal driver component;

bbb. a hexagonal driver component headhole;

ccc. a second file component;

ddd. a second file component headhole; and eee. said first punch component, said second punch component, said hexagonal driver component and second file component being pivotably assembled to and within said second handle by way of a threading of said fourth pivot screw through said second topside second handle hole, said first punch component headhole, said second punch component headhole, said hexagonal driver component headhole, said second file component head hole, then said second bottom side second handle hole into said fourth pivot screw bushing unit.

* * * * *